United States Patent [19]

Jones

[11] 4,347,898

[45] Sep. 7, 1982

[54] SHEAR RAM BLOWOUT PREVENTER

[75] Inventor: Marvin R. Jones, Houston, Tex.

[73] Assignee: Cameron Iron Works, Inc., Houston, Tex.

[21] Appl. No.: 204,451

[22] Filed: Nov. 6, 1980

[51] Int. Cl.[3] ..... E21B 29/08; E21B 33/06

[52] U.S. Cl. ..... 166/55; 251/1 A; 277/129

[58] Field of Search ..... 166/55; 251/1 A; 277/129

[56] References Cited

U.S. PATENT DOCUMENTS

| | | | |
|---|---|---|---|
| 2,060,248 | 11/1936 | Schweitzer | 277/129 |
| 2,060,252 | 11/1936 | Shaffer et al. | 277/129 |
| 2,919,111 | 12/1959 | Nicolson | 166/55 |
| 3,561,526 | 2/1971 | Williams, Jr. et al. | 166/55 |
| 3,736,982 | 6/1973 | Vujasinovic | 166/55 |
| 3,817,326 | 6/1974 | Meynier | 166/55 |
| 3,946,806 | 3/1976 | Meynier | 166/55 |
| 4,132,265 | 1/1979 | Williams, Jr. | 166/55 |
| 4,132,266 | 1/1979 | Randall | 166/55 |
| 4,240,503 | 12/1980 | Holt, Jr. et al. | 166/55 |

*Primary Examiner*—James A. Leppink
*Attorney, Agent, or Firm*—Vinson & Elkins

[57] ABSTRACT

There is disclosed a ram type blowout preventer having a pair of shear rams adapted to shear pipes suspended in the bore of the preventer and subsequently seal off the bore. The rams utilize a transverse packing for sealing between the shear blades when they are closed. One shear ram has a ramp adapted to engage a shoulder on the opposing ram so as to urge the shearing blades closer together as they are closing and thereby reduce the vertical gap which the transverse seal must bridge.

10 Claims, 4 Drawing Figures

SHEAR RAM BLOWOUT PREVENTER

BACKGROUND OF THE INVENTION

Oilwell drilling operations are conducted through a stack of one or more blowout preventers which are connected to a wellhead member or an extension of a wellhead member. The blowout preventers are necessary to ensure that the drilling contractor will be able to control the well even if a zone of high pressure is penetrated by the drill bit. Occasionally, emergency situations arise where it is necessary to shear the drill pipe and close off the bore of the blowout preventer. To accomplish this, one of the blowout preventers in the stack is equipped with shear rams. Two types of seals have been previously provided for shear rams. The first type includes cross seal packers configured to seal in an essentially vertical plane with the opposing ram, as shown in the K. M. Nicolson U.S. Pat. No. 2,919,111 and the L. E. Williams, Jr. et al. U.S. Pat. No. 3,561,526. The second type of shear ram seals utilizes an essentially horizontal transverse blade seal configured to seal along the shear plane and between the opposing blades, as exemplified in the U.S. Pat. Nos. to A. N. Vujasinovic (3,736,982) and M. J. Meynier III (3,817,326 and 3,946,806).

When the latter type is employed and pipe is sheared, the shearing action tends to force the blades vertically apart and thus increases the gap that must be briged by the horizontal transverse blade seal. In high pressure situations the transverse seal tends to be damaged while attempting to bridge the increased gap.

The F. J. Schweitzer U.S. Pat. No. 2,060,248 and the W. D. Shaffer et al U.S. Pat. No. 2,060,252 both disclose blowout preventer rams that are mortised and tenoned to overlap and limit the upward extrusion of the packing. Neither of these patents suggest the problem mentioned above of sealing in the shearing plane between the blades at high well pressures.

SUMMARY OF THE INVENTION

The present invention relates to shear ram blowout preventers. The preventers include shear rams of the type which uses a transverse element for sealing between the blades in the shear plane. One ram has a ramp adapted to engage a shoulder on the opposing ram so as to urge the shearing blades closer together as they are closing and thereby reduce the vertical gap which the transverse seal must bridge. Also, the side edges of the shear blades are provided with chamfers so that blade engagement of the opposing side packers does not damage them.

An object of the present invention is to provide an improved shear type blowout preventer which is able to withstand very high forces tending to separate the shear blades without damage to the seals.

Another object is to provide an improved shear ram assembly for a blowout preventer which minimizes the vertical separation of the blades during and subsequent to shearing.

A further object is to provide an improved shear ram assembly for a blowout preventer in which the side packing is protected from damage resulting from engagement of the packing by the sharp corners of the shear blade.

BRIEF DESCRIPTION OF THE DRAWINGS

These and other objects and advantages of the present invention are hereinafter set forth and explained with reference to the drawings wherein.

DESCRIPTION OF THE PREFERRED EMBODIMENT

Figure 1:
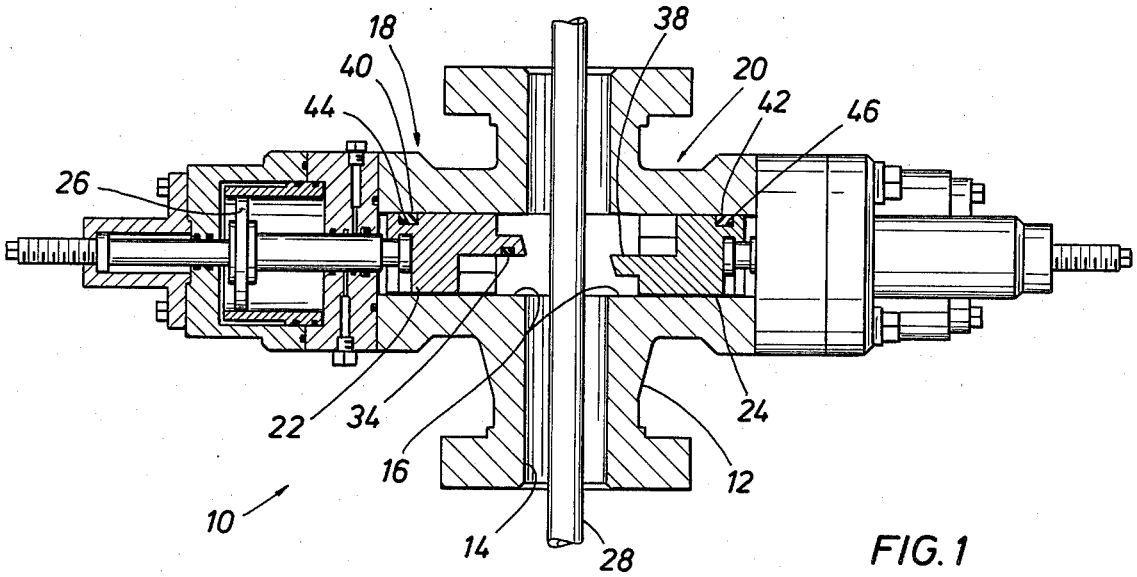
FIG. 1 is an elevation view partly in section of the improved blowout preventer of the present invention.

Improved blowout preventor 10 of the present invention includes body 12 having pipe opening 14 extending therethrough and guideways 16 intersecting pipe opening 14, with ram assemblies 18 and 20 having rams 22 and 24 in guideways 16 and moved therein by piston 26.

Figure 2:
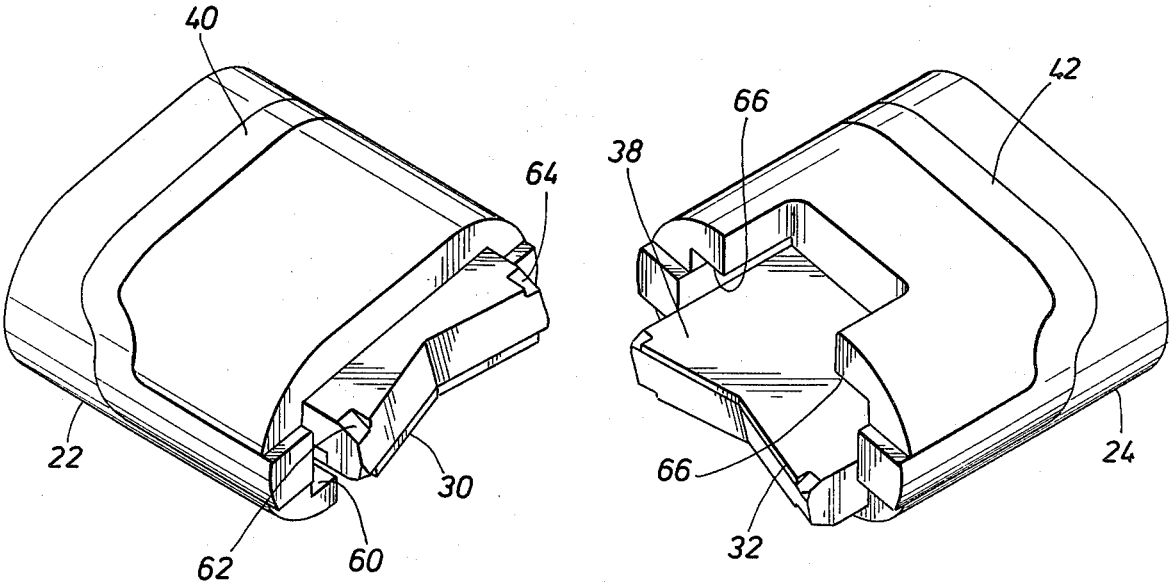
FIG. 2 is a perspective view of the improved shear ram assemblies of the present invention.

Ram assemblies 18 and 20 are the type adapted to shear pipe section 28 which is positioned in pipe opening 14 when ram assemblies 18 and 20 are actuated to close. Ram 22 includes blade 30 which coacts with blade 32 on ram 24 to shear pipe section 28. As shown, blade 30 is the upper blade and blade 32 is the lower blade. Both blades 30 and 32 project outward from their respective rams and are indented centrally or V-shaped, as best seen in FIG. 2, to assure that the pipe section being sheared is fully centered and sheared by blades 30 and 32. Seal 34 is positioned in groove 36 in blade 30 and when rams 22 and 24 are closed seals against upper surface 38 of blade 32 and at its ends against ram seals 40 and 42. Ram seal 40 is positioned in groove 44 extending along the sides and across the top of ram 22 and ram seal 42 is positioned in groove 46 extending along the sides and across the top of ram 24. Ram seals 40 and 42 and seal 34 provide a seal to retain the pressure below blowout preventer 10 when ram assemblies are closed.

With V-shaped blades, the corners are pointed and may have a tendency to catch on the side packing as the blades are closed. With a pipe section 28 being sheared, there is a tendency for the blades to be separated. The blades 30 and 32 of the present invention have configurations which avoid serious complications from these problems.

Figure 3:
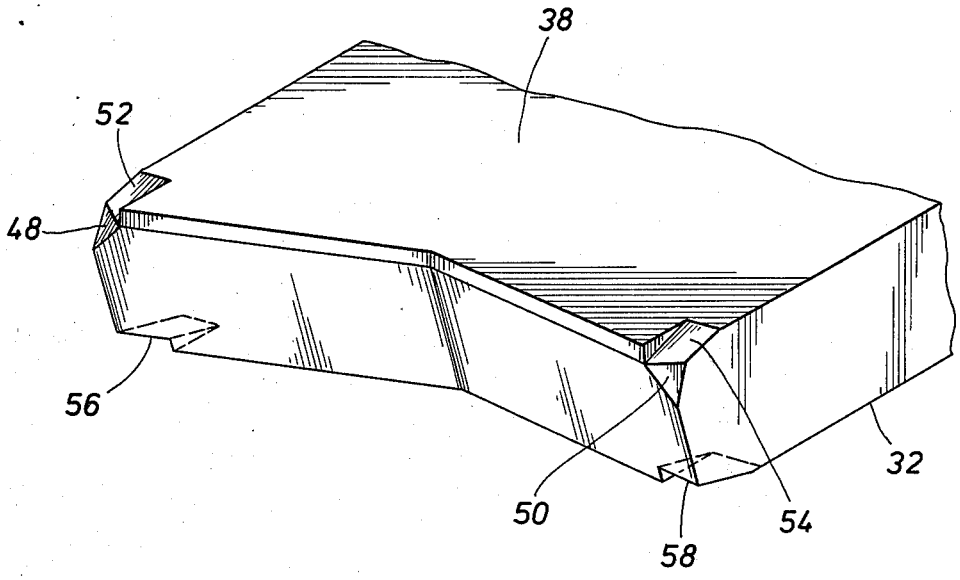
FIG. 3 is an enlarged view of one side of the shear blade to illustrate the side packing chamfer and the wedge track typical of the shear blades.
Figure 4:
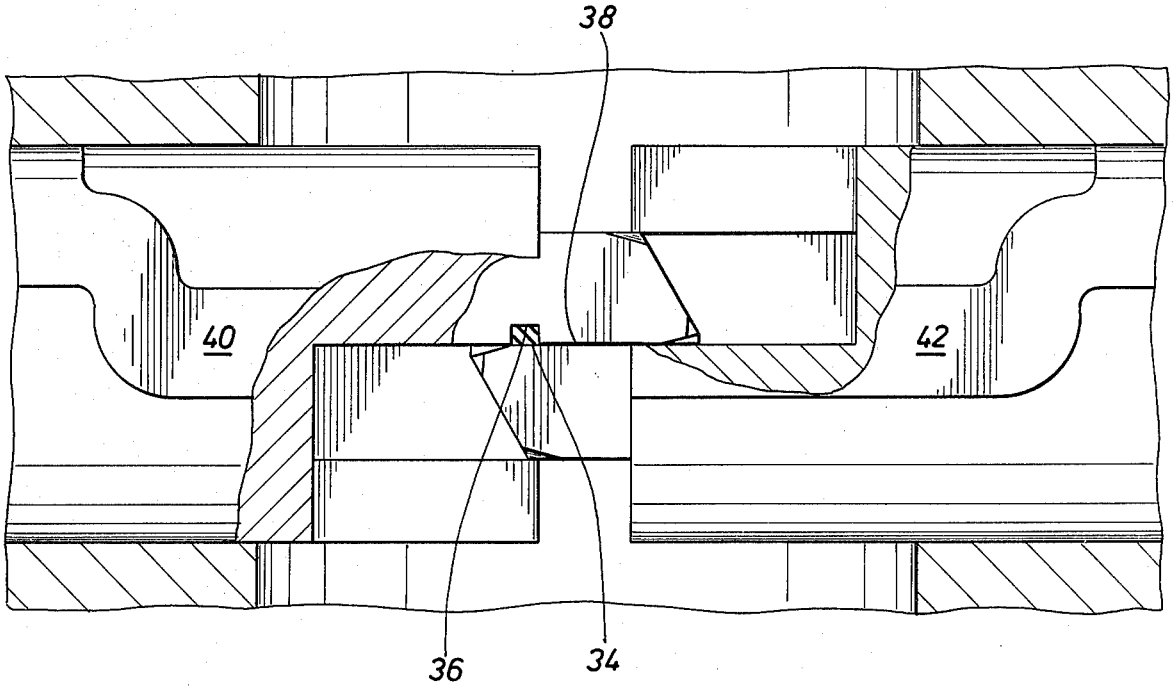
FIG. 4 is another elevation view showing the shear blades in engagement with their wedge tracks engaging the shoulders on the opposing ram.

Blade 32, as best seen in FIG. 3 is provided with corners at the upper forward surface of the blade which are beveled in two directions as shown. Each corner is beveled to provide the surfaces 48 and 50 which are tapered forwardly and toward the center of the blade. Each corner is also beveled to provide surfaces 52 and 54 which taper upwardly to the rear of blade 32. With these beveled surfaces, there is no catching of the corners of blade 30 on the seals.

Blade 32 also has the ramps 56 and 58 at each side thereof both of which taper downwardly to the rear as shown. Blade 30 also has ramps 62 and 64 at each side of its upper surface, both of which taper downwardly to the front as shown. Ramps 56 and 58 coact with shoulders 60 on ram 22 below blade 30. Ramps 62 and 64 coact with shoulders 66 on ram 24 above blade 32 so that as the blades close the ramps engaging on the shoulders will wedge the blades together to proper sealing position. This structure resists the very high packing forces tending to separate the blades and reduces the gap which the transverse seal 34 must bridge to seal against the upper surface 38 of blade 32.

What is claimed is:

1. A blowout preventer comprising a housing having a bore therethrough, ram guideways extending outwardly from said bore, rams mounted for reciprocation in said guideways and having shearing means on their inner faces, means for moving said rams together to close off said bore and apart to open said bore, means for sealing between said shearing means, a shoulder on one of said rams, and ramp means on the other of said rams adapted to engage said shoulder as said shearing means is moved to closed position whereby said shearing means are urged toward each other to minimize the gap to be sealed by said sealing means.

2. A blowout preventor according to claim 1 wherein said shearing means includes an upper shear blade on one of said rams and a lower shear blade on the other of said rams, the lower outer corners of said lower shear blade including ramps tapered downwardly toward the rear to provide said ramp means.

3. A blowout preventer according to claim 2 wherein the ram opposite said lower shear blade includes a generally horizontal surface below said upper shear blade at each side of said ram to provide said shoulder engaged by said ramp means.

4. A blowout preventer according to claim 2 wherein said sealing means includes a transverse seal member positioned in a groove on the underside of said upper shear blade and adapted to seal against the upper surface of said lower shear blade.

5. A blowout preventer according to claim 2 including a beveled surface on each of the upper outer corners of said lower shear blade to avoid damage to the side packing resulting from engagement thereof by the corners of said lower blade.

6. A blowout preventer according to claim 5 wherein said beveled surface is substantially vertical and tapers inward toward the center of the blade in the forward direction and including a second beveled surface on each corner tapering downwardly in the forward direction.

7. A blowout preventer, comprising a body having a pipe opening therethrough, ram guideways extending laterally from opposite sides of the pipe opening, a ram assembly including a pair of rams each positioned in one of said guideways and means for moving the rams together to close off the pipe opening and for moving the rams apart to open the pipe opening, each of said rams having a pipe shearing blade extending inward and a recess for receiving the blade of the opposite ram, seal means for each of said rams including a transverse packing carried by one of the shear blades for sealing between the shear blades, the recess in each of said rams defining side shoulders facing the shear plane, and a tapered ramp on each side of each of the shear blades facing away from the shear plane and adapted to engage the recess shoulders of the opposite ram as said blades move to closed position whereby said blades are urged toward each other to minimize the gap between the shear blades in closed position.

8. A blowout preventer according to claim 7, including seal means carried by each of said rams at the side of its blade recess, the corner of each of said shear blades being chamfered so that said blades do not damage said side sealing means as they come into contact therewith.

9. A ram assembly for use in a blowout preventer comprising a first ram having an upper shear blade on its inner face, a second ram having a lower shear blade on its inner face, said upper shear blade having a transverse groove on its lower surface, a transverse seal positioned in said groove and adapted to seal against the upper surface of said lower shear blade, a shoulder on one of said rams, and ramp means on the other of said rams adapted to engage said shoulder as said blades move together to closed position whereby said blades are urged toward each other to minimize the gap to be sealed by said transverse seal.

10. A ram assembly according to claim 9 wherein the lower outer corners of said lower shear blade include ramps tapered downwardly toward the rear to provide said ramp means, and said first ram includes surfaces at the side and below said upper shear blade to provide shoulders for engagement by the ramps on said lower shear blade.

* * * * *